US010134236B2

(12) United States Patent
Hawkins

(10) Patent No.: US 10,134,236 B2
(45) Date of Patent: Nov. 20, 2018

(54) ENHANCED PRESENTATION OF A SELECTED WINNING PRIZE LEVEL IN A PICK TO REVEAL JACKPOT GAME

(71) Applicant: Aristocrat Technologies Australia Pty Limited, North Ryde, NSW (AU)

(72) Inventor: Ryan Hawkins, Henderson, NV (US)

(73) Assignee: ARISTOCRAT TECHNOLOGIES AUSTRALIA PTY LIMITED (AU)

( * ) Notice: Subject to any disclaimer, the term of this patent is extended or adjusted under 35 U.S.C. 154(b) by 61 days.

(21) Appl. No.: 15/274,515

(22) Filed: Sep. 23, 2016

(65) Prior Publication Data

US 2018/0089945 A1 Mar. 29, 2018

(51) Int. Cl.
*G07F 17/32* (2006.01)

(52) U.S. Cl.
CPC ..... *G07F 17/3258* (2013.01); *G07F 17/326* (2013.01); *G07F 17/3209* (2013.01); *G07F 17/3211* (2013.01); *G07F 17/3225* (2013.01); *G07F 17/3246* (2013.01); *G07F 17/3248* (2013.01); *G07F 17/3251* (2013.01); *G07F 17/3262* (2013.01); *G07F 17/3267* (2013.01)

(58) Field of Classification Search
None
See application file for complete search history.

(56) References Cited

U.S. PATENT DOCUMENTS 6,659,864 B2 * 12/2003 McGahn ..... G07F 17/3211 273/138.2
6,733,386 B2 * 5/2004 Cuddy ..... G07F 17/32 463/17
7,238,109 B2 * 7/2007 McGahn ..... G07F 17/3211 273/138.1
7,604,540 B2 * 10/2009 Olive ..... G07F 17/3258 463/20
8,282,470 B2 * 10/2012 Englman ..... G07F 17/3267 463/16
8,287,366 B2 * 10/2012 Olive ..... G07F 17/3258 273/138.1
8,608,556 B2 * 12/2013 Olive ..... G07F 17/3258 273/138.1
8,992,301 B2 * 3/2015 Caputo ..... G07F 17/3213 463/16
9,633,511 B2 * 4/2017 Caputo ..... G07F 17/326
(Continued)

*Primary Examiner* — David Duffy
(74) *Attorney, Agent, or Firm* — McAndrews, Held & Malloy, Ltd.

(57) ABSTRACT

An electronic method of gaming includes displaying, on a display, a pick to reveal jackpot game having a game board portion presenting a plurality of selectable symbols. The method includes selecting, by a game controller, a winning prize level from a plurality of prize levels. The method includes selecting, by the game controller, a pathway to the selected winning prize level from a plurality of pathways to the selected winning prize level. The method includes selecting, by the game controller, a multiplier for each of the prize levels. In various embodiments, one or more of the multipliers is greater than times one. The method includes displaying, by the game controller on the display, the selected pathway to the selected winning prize level with the one or more of the selected multipliers greater than times one in response to a sequence of user selections of a subset of the selectable symbols.

20 Claims, 13 Drawing Sheets

(56) References Cited

U.S. PATENT DOCUMENTS

| | | | | |
|---|---|---|---|---|
| 9,659,451 | B2 * | 5/2017 | Olive | G07F 17/3258 |
| 2002/0183109 | A1 * | 12/2002 | McGahn | G07F 17/3211<br>463/20 |
| 2003/0040357 | A1 * | 2/2003 | Baerlocher | G07F 17/32<br>463/20 |
| 2003/0162583 | A1 * | 8/2003 | Baerlocher | G07F 17/32<br>463/20 |
| 2003/0222402 | A1 * | 12/2003 | Olive | G07F 17/3258<br>273/292 |
| 2004/0023710 | A1 * | 2/2004 | McGahn | G07F 17/3211<br>463/16 |
| 2005/0054416 | A1 * | 3/2005 | Hostetler | G07F 17/32<br>463/16 |
| 2005/0101375 | A1 * | 5/2005 | Webb | G07F 17/3211<br>463/25 |
| 2007/0117607 | A1 * | 5/2007 | Olive | G07F 17/3258<br>463/16 |
| 2009/0270162 | A1 * | 10/2009 | Kim | G07F 17/3244<br>463/20 |
| 2010/0099490 | A1 * | 4/2010 | Olive | G07F 17/3258<br>463/26 |
| 2010/0285870 | A1 * | 11/2010 | Englman | G07F 17/3244<br>463/27 |
| 2013/0005431 | A1 * | 1/2013 | Olive | G07F 17/3258<br>463/20 |
| 2014/0094291 | A1 * | 4/2014 | Olive | G07F 17/3258<br>463/26 |
| 2016/0232751 | A1 * | 8/2016 | Caputo | G07F 17/326 |
| 2017/0039812 | A1 * | 2/2017 | Baron | G07F 17/3293 |

* cited by examiner

ENHANCED PRESENTATION OF A SELECTED WINNING PRIZE LEVEL IN A PICK TO REVEAL JACKPOT GAME

RELATED APPLICATIONS

[Not Applicable]

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

In electronic gaming systems such as pick to reveal jackpot gaming machines, symbols are selected to reveal tokens corresponding to a prize level for presentation on a display of the machine. The symbols are selected until a predetermined number of tokens corresponding to one of the prize levels are displayed to determine the prize level to award to a player.

While such gaming systems provide players with enjoyment, a need exists for new gaming systems in order to maintain or increase player enjoyment.

BRIEF SUMMARY OF THE INVENTION

A system and/or method is provided for a pick to reveal jackpot game having randomly determined multipliers awarded for each of a plurality of prize levels, wherein one or more of the multipliers are presented at a display of a gaming machine in association with the corresponding one or more prize levels, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

BRIEF DESCRIPTION OF SEVERAL VIEWS OF THE DRAWINGS

Embodiments of the invention will now be described with reference to the accompanying drawings in which.

DETAILED DESCRIPTION OF THE INVENTION

Figure 1:
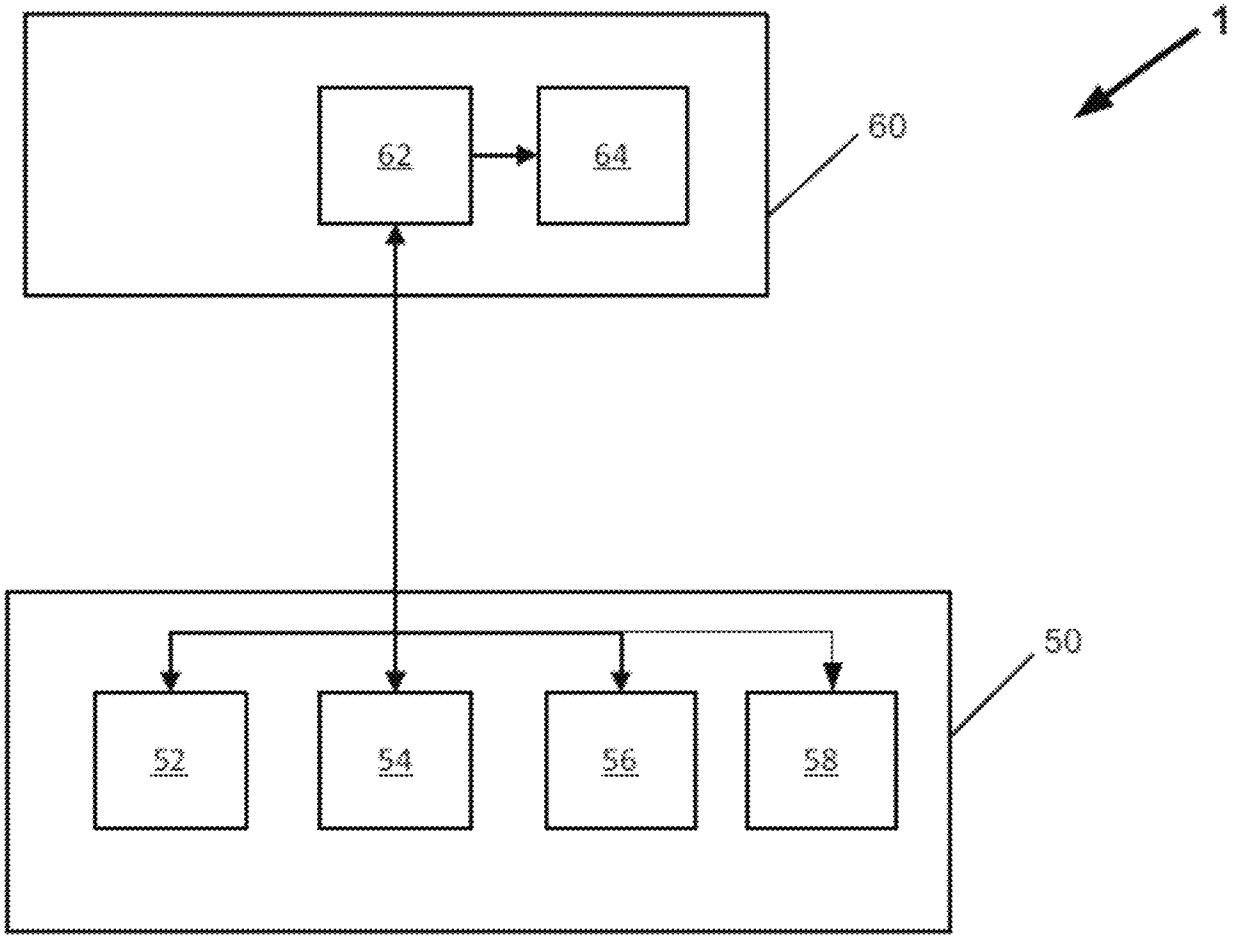
FIG. 1 is a block diagram of the core components of a gaming system.

Referring to the drawings, there is shown an embodiment of an electronic gaming system having an electronic game controller arranged to operate the gaming system to implement a game where a pick to reveal jackpot game is conducted on a game board portion of a display to determine a prize level award depicted in a prize level display portion of the display. The gaming system is configured to present a plurality of prize levels having different prize values in the prize level display portion of the display. The gaming system is configured to present a number of selectable symbols that reveal different prize level tokens upon selection by a user in the game board portion of the display. The number of selectable symbols set forth in the game board portion may depend on the number of prize levels and the number of prize level tokens that need to be selected to win. For example, if there are four prize levels (e.g., grand, major, minor, and mini) and three tokens of the same prize level need to be selected to win that prize level, the game board may include twelve selectable symbols. The selectable symbols may be presented in the game board as a grid or any suitable arrangement.

In various embodiments, the gaming system is configured to select a winning prize level, a pathway to that prize level, a multiplier for winning and/or non-winning prize levels, and a pick number to reveal the selected multiplier for each of the prize levels having a multiplier different from times one (×1). For example, the gaming system may be configured to select the winning prize level, the pathway to the winning prize level, the multiplier for winning and/or non-winning prize levels, and/or the pick number to reveal the selected multiplier based on weighted tables. The selected pathway to the selected prize level with the selected multiplier at the appropriate pick number is displayed in response to a sequence of user selections of symbols presented at the game board.

In certain embodiments, a multiplier for each prize level and a pick number to reveal the selected multiplier for each of the prize levels may be selected. Then, in response to a user selection of a symbol presented at the game board, the gaming system is configured to select a prize level and display the selected prize level with the multiplier if it is the appropriate pick number to display the multiplier. The gaming system is configured to continue selecting and displaying the selected prize level with the multiplier (if appropriate) in response to user selections until a predetermined winning number of prize level tokens have been displayed to determine the prize level to award to the user. The gaming system may be configured to select the multiplier for each prize level, the pick number to reveal the selected multiplier for each of the prize levels, and the prize level associated with each pick based on weighted tables.

In an exemplary embodiment, the gaming system is configured to select a winning prize level, select a multiplier for the winning and/or non-winning prize levels, and select a token corresponding to each of the prize levels and place the selected multiplier (other than times one (×1)) on the token. For example, the gaming system may be configured to select the winning prize level and the multiplier for winning and/or non-winning prize levels based on weighted tables. The gaming system is configured to randomly place n winning prize level tokens and n−1 non-winning prize level tokens under selectable symbols of the game board. In various embodiments, the gaming system is configured to randomly place credit prize tokens under unused selectable symbols of the game board. The gaming system is configured to sequentially display tokens corresponding with the user selections of the selectable symbols until the n winning prize level tokens are all displayed.

General Construction of Gaming System

The gaming system can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system 1 has several core components. At the broadest level, the core components are a player interface 50 and a game controller 60 as illustrated in FIG. 1. The player interface 50 is arranged to enable manual interaction between a player and the gaming system 1 and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface 50 and typically includes a processor 62 that processes the game play instructions in accordance with game play rules and outputs game play outcomes to the display(s) 54. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
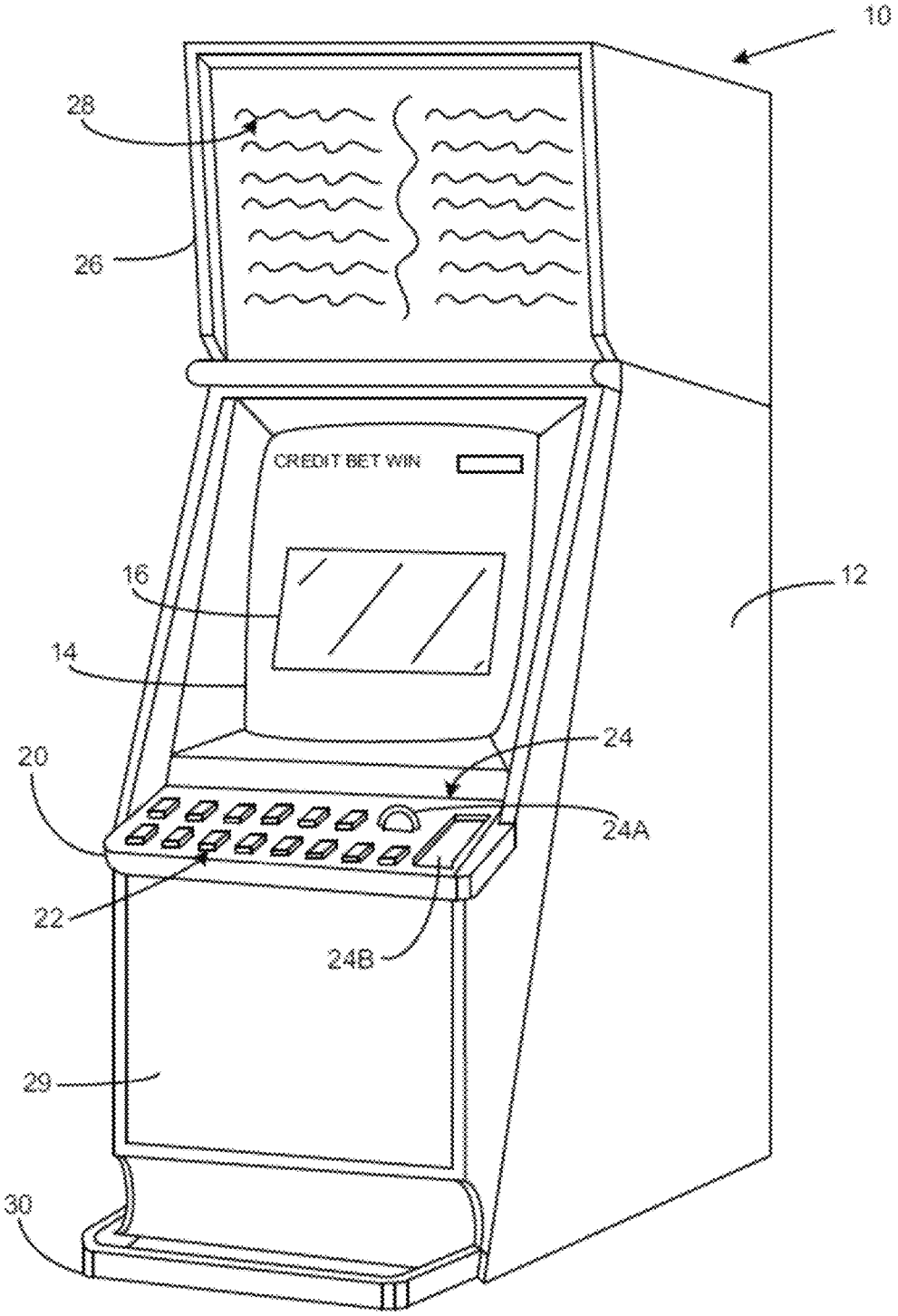
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may be configured to accept a ticket such that they have a ticket reader for reading tickets having a value and crediting the player based on the face value of the ticket. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a liquid crystal display. Alternatively, the display 14 may be a light emitting diode display, plasma screen, and/or any other suitable video display unit. The top box 26 may also include a display, for example a video display unit, which may be of the same type as the display 14, or of a different type.

Figure 3:
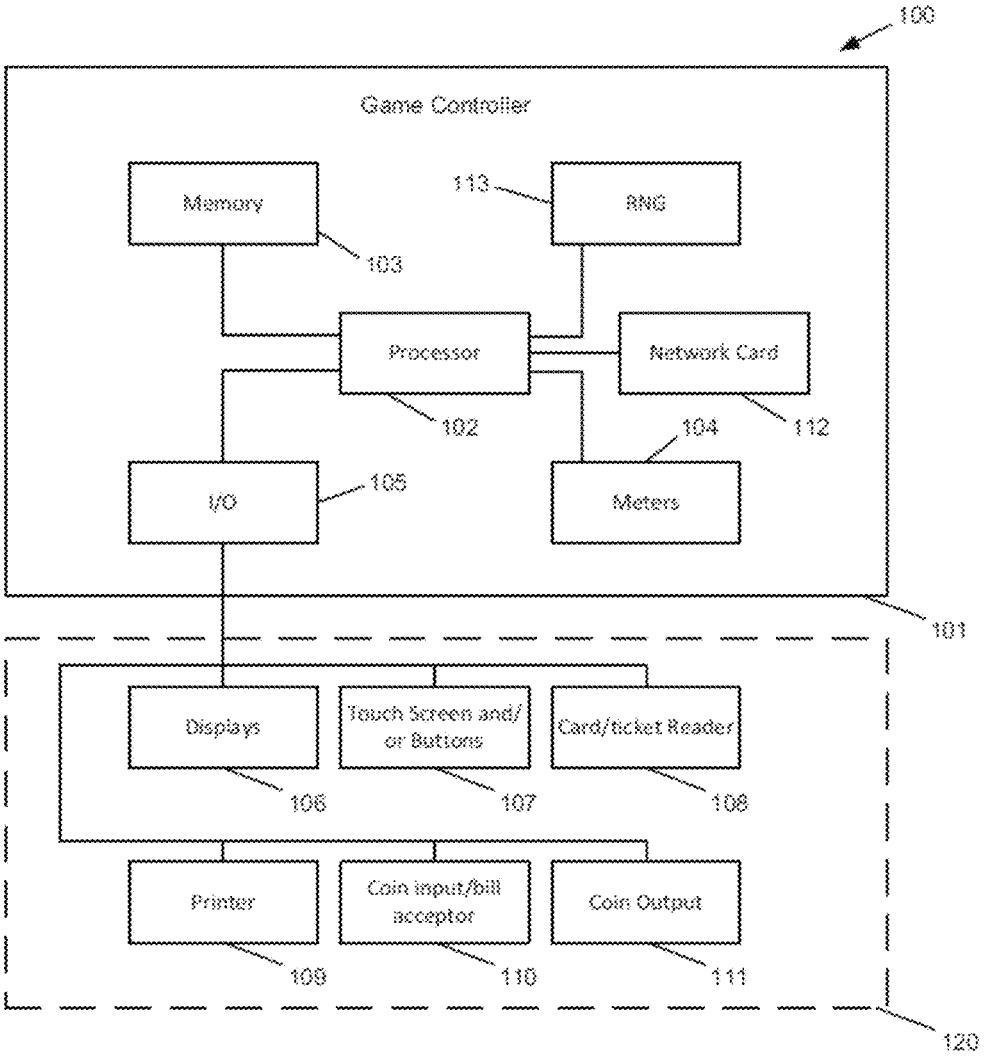
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game, any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
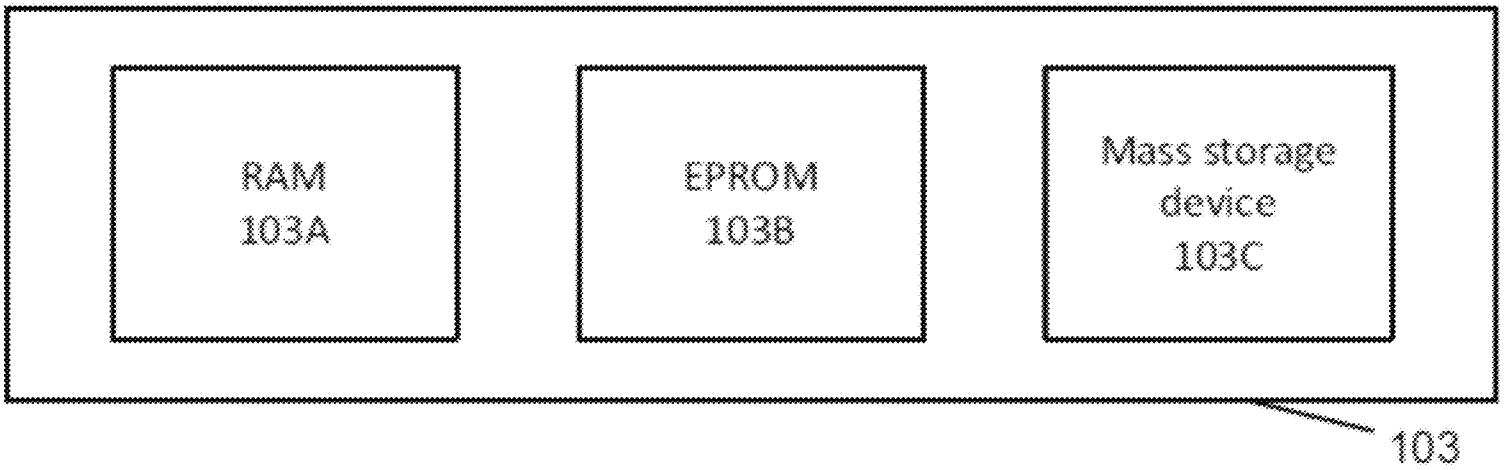
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106, 107, 108, 109, 110, 111 to be provided remotely from the game controller 101.

Figure 5:
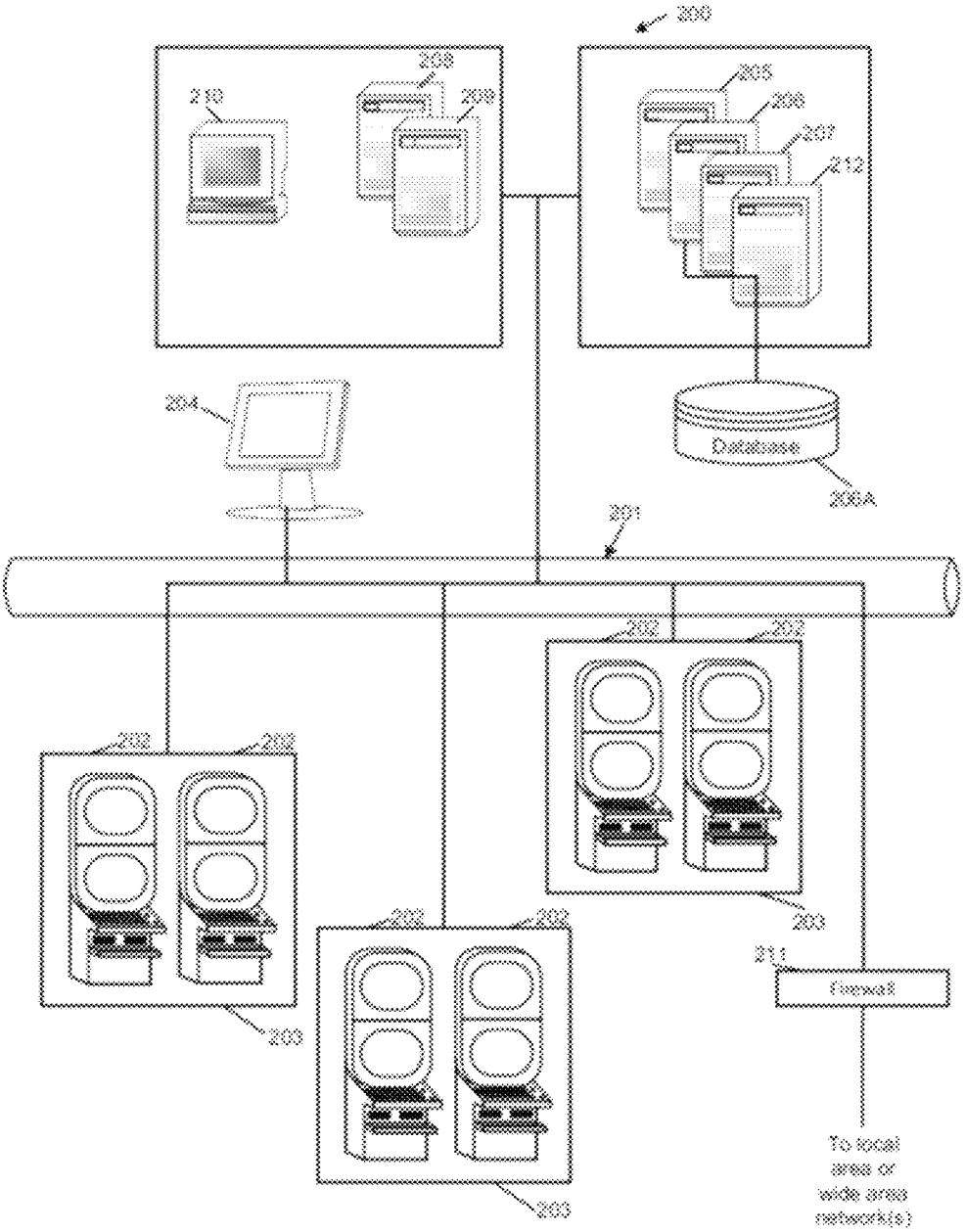
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5 are connected to the network 201. The gaming machines 202 provide a player operable interface and may be the same as the gaming machines 10, 100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

The player operates the game play mechanism 56 to specify a wager for the game and to initiate a play of the game. In an exemplary embodiment, at least certain of the wagers that the player can wager entitles the player to a pick to reveal jackpot game as shown in FIGS. 10A-D.

Figure 6:
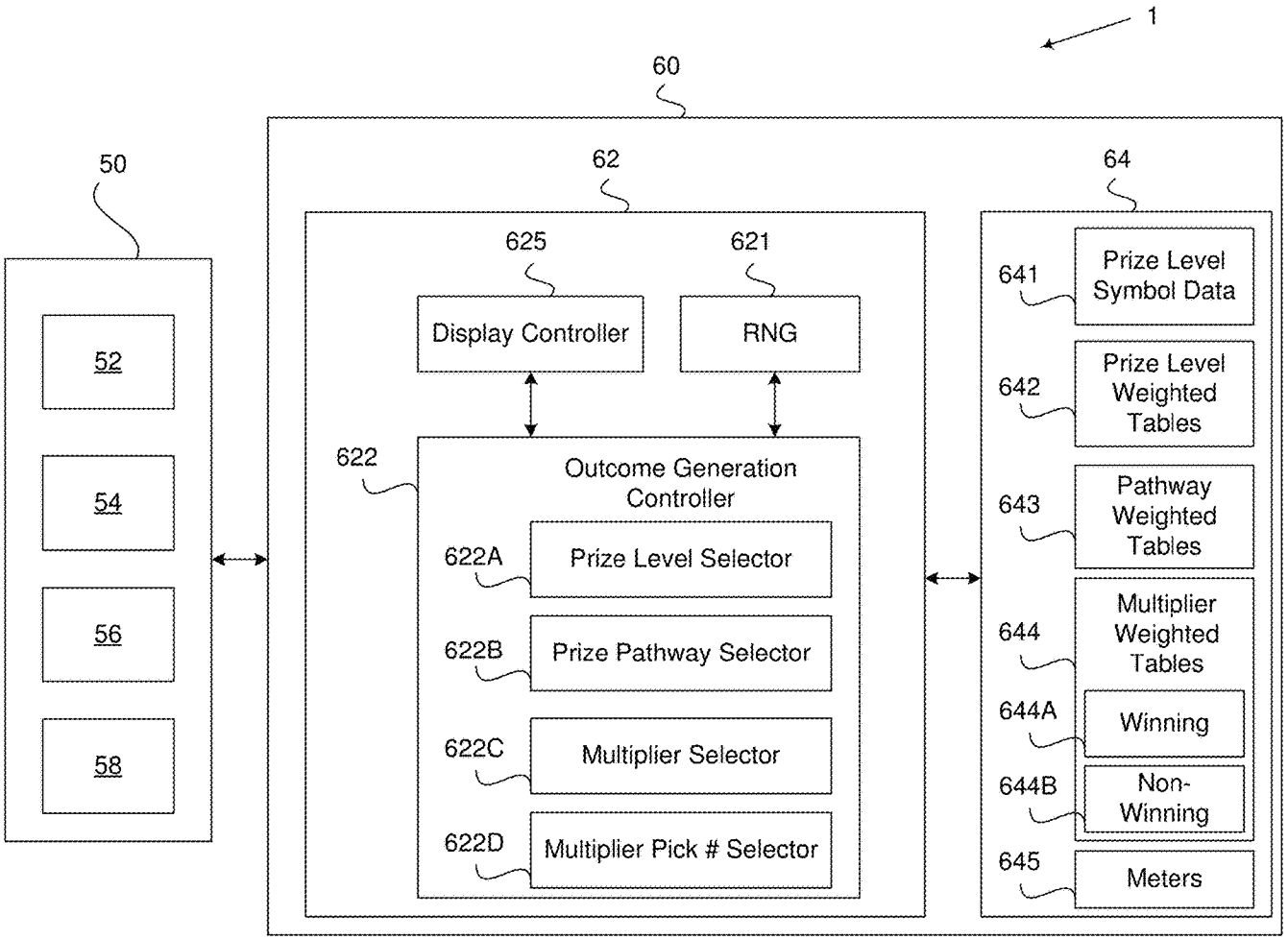
FIG. 6 is a further block diagram of a gaming system.

In FIG. 6, the processor 62 of game controller 60 of gaming system 1 is shown implementing a number of modules based on game program code 641-645 stored in memory 64. Persons skilled in the art will appreciate that various modules could be implemented in some other way, for example by a dedicated circuit.

Figure 10A:
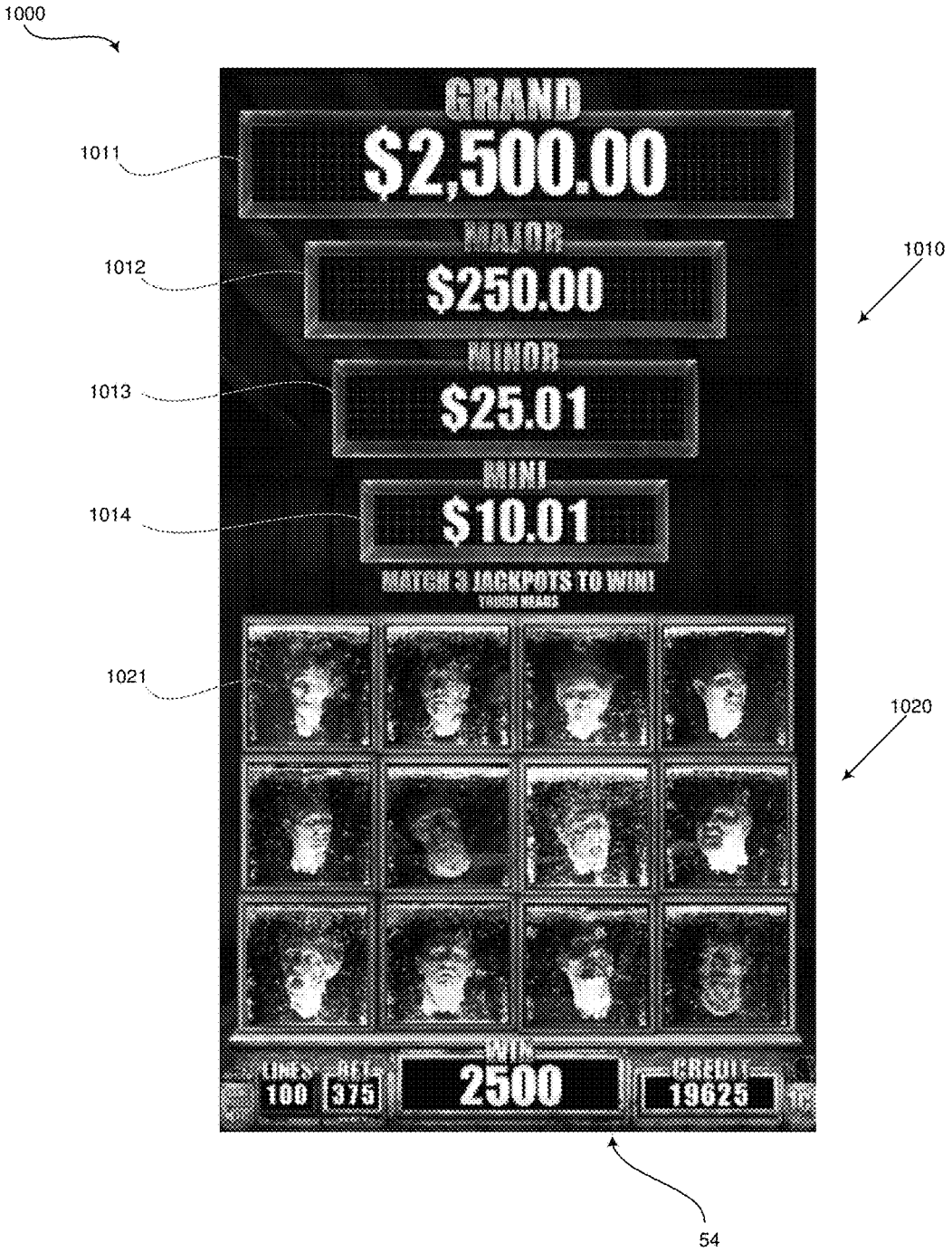
FIG. 10A is a screen shot of an example of a display of a pick to reveal jackpot game having a prize level display portion and a game board portion.

These modules include display controller 625 which controls the display 54 to present the game display 1000 having the prize level display portion 1010 and the game board portion 1020. In an embodiment, the prize level display portion 1010 presents each of the prize levels 1011-1014 and the award value associated with each prize level 1011-1014. For example, as illustrated in FIG. 10A, the pick to reveal jackpot game may have four prize levels 1011-1014 each having an associated award value (e.g., a $2500.00 grand prize level 1011, a $250 major prize level 1012, a $25.01 minor prize level 1013, and a $10.01 mini prize level 1014). Although four prize levels 1011-1014 are shown in FIG. 10A, any suitable number of prize levels is contemplated, such as two prize levels, three prize levels, five prize levels, and the like. Still referring to FIG. 10A, the game board portion 1020 may be a rectangular array of selectable symbols 1021 arranged in a plurality of rows and a plurality of columns. The number of selectable symbols 1021 set forth in the game board portion 1020 may depend on the number of prize levels 1011-1014 and the number of prize level tokens that need to be selected to win. For example, in the embodiment of FIG. 10A having four prize levels 1011-1014 and three tokens of the same prize level need to be selected to win that prize level, the game board may include twelve selectable symbols 1021.

Figure 10B:
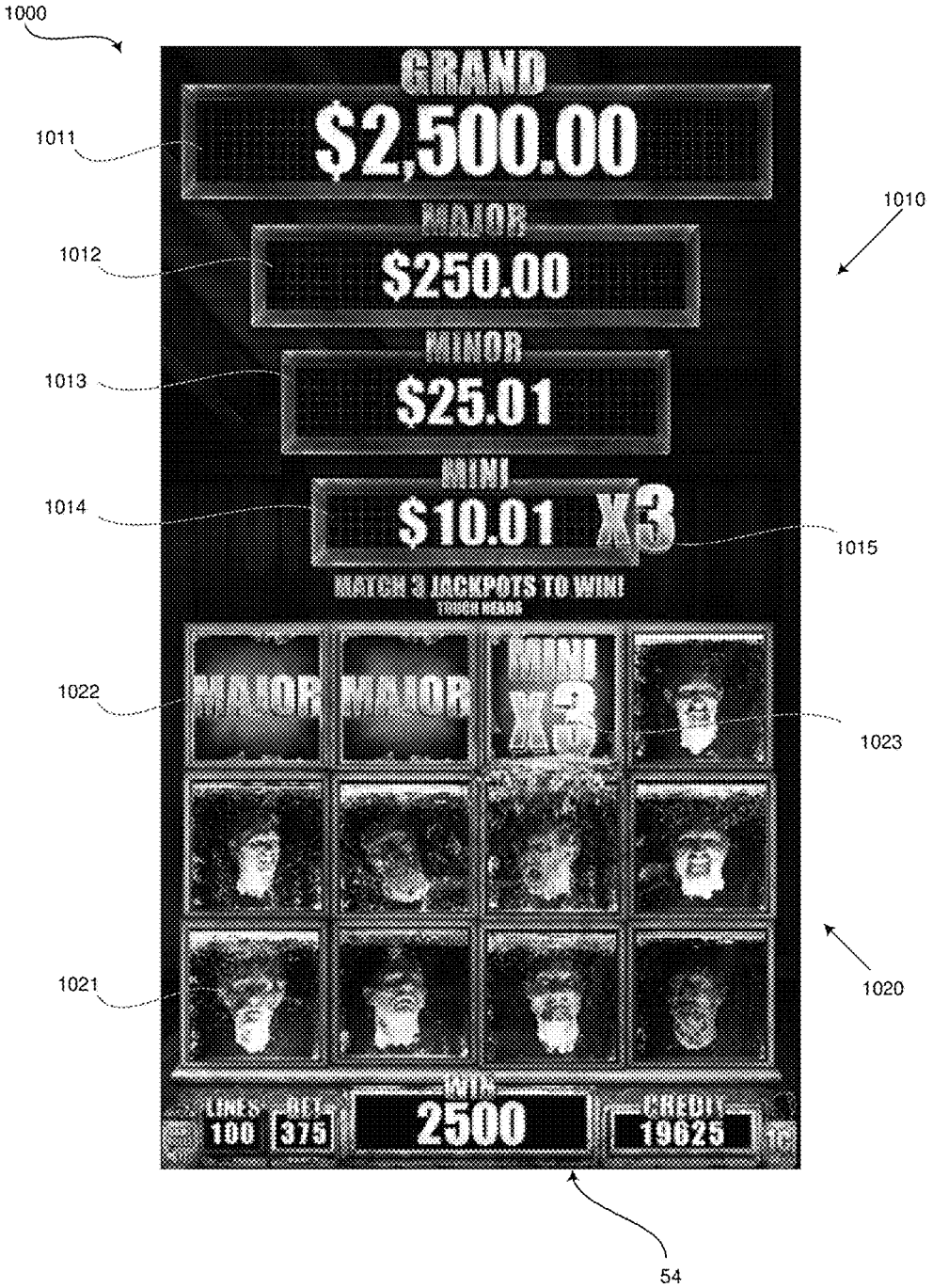
FIG. 10B is a screen shot of an example of a display of a pick to reveal jackpot game having a prize level display portion and a game board portion presenting a multiplier for a prize level.
Figure 10C:
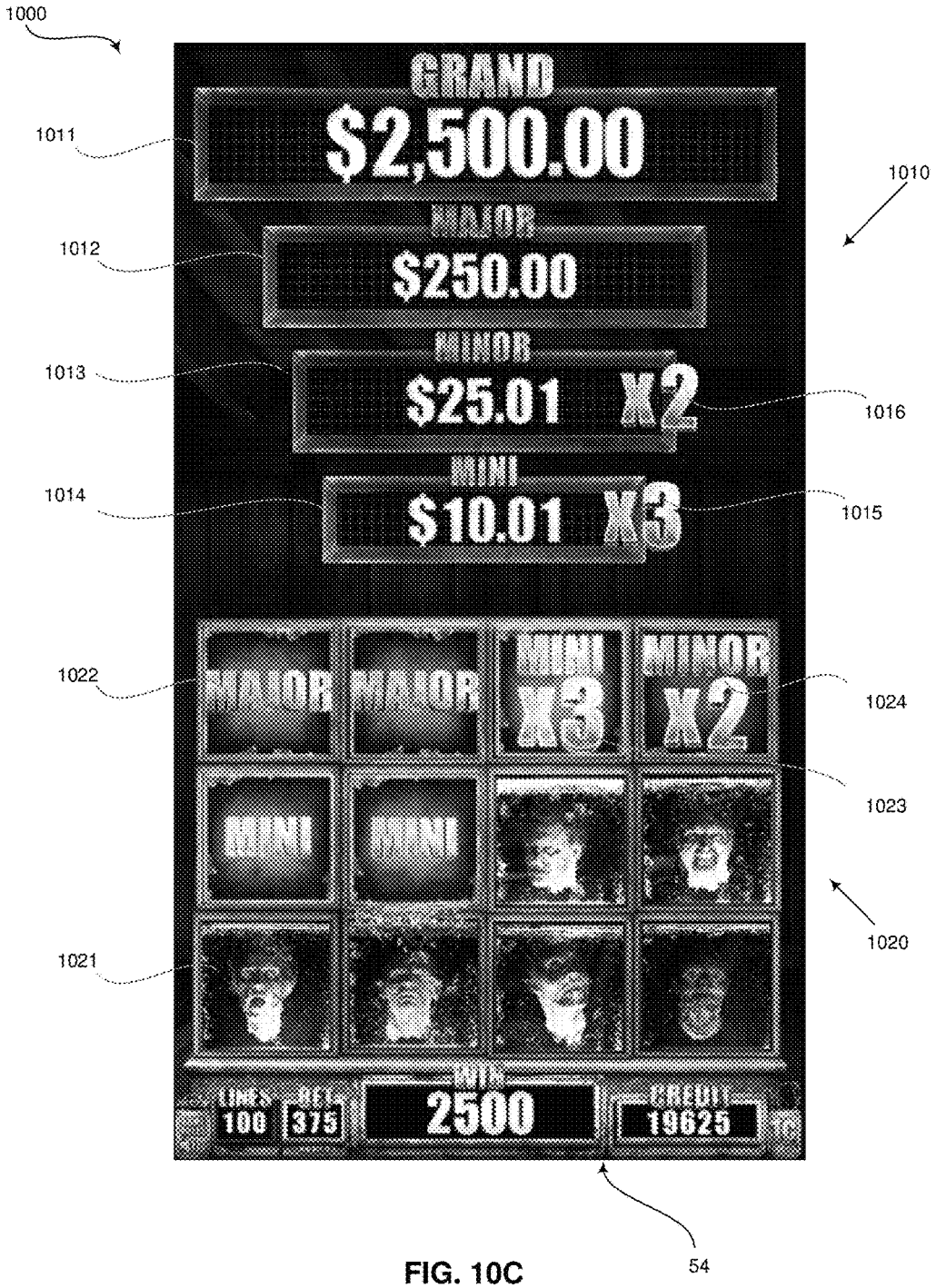
FIG. 10C is a screen shot of an example of a display of a pick to reveal jackpot game having a prize level display portion and a game board portion presenting a winning prize level and multipliers for different prize levels.
Figure 10D:
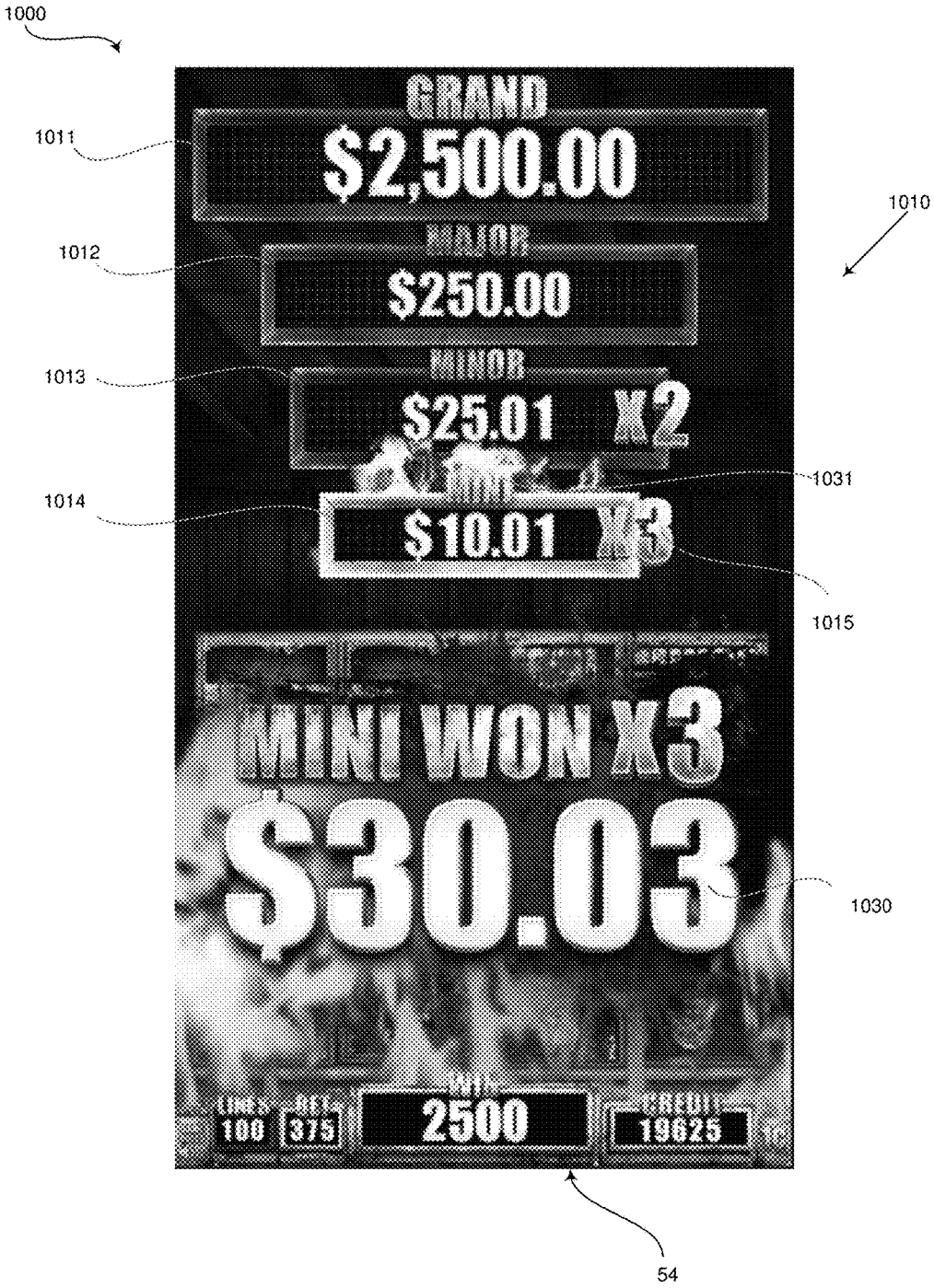
FIG. 10D is a screen shot of an example of a display of a pick to reveal jackpot game presenting the winning jackpot prize level awarded.

As can be seen from FIG. 10A, initially the selectable symbols 1021 appear to cover or hide prize level tokens that correspond with each of the prize levels 1011-1014 in the prize level display portion 1010. As a user sequentially selects the symbols 1021, the prize level tokens 1022 are sequentially revealed in the position formerly occupied by the selectable symbol 1021 as shown in FIG. 10B. In various embodiments, the award value associated with one or more of the prize levels may be modified by a multiplier 1015, 1023. The multiplier is revealed in response to a user selection of a selectable symbol 1021 and is presented on the game display 1000 with the prize level token 1023 in the game board portion 1020 of the game display 1000. The multiplier 1015 may also be shown with the corresponding prize level 1014 in the prize level display portion 1010 of the game display 1000. For example, as the multiplier is displayed with the prize level token 1023 at the game board portion 1020, a duplicate multiplier 1015 may float up from the token 1023 to be presented adjacent the appropriate prize level 1014 in the prize level display portion 1010. As shown in FIG. 10C, the user continues selecting the symbols 1021 until a predetermined number of prize level tokens 1022, including multipliers 1023, 1024 where applicable, are displayed to determine the winning prize level. A presentation 1030, 1031 of the determined winning prize level may then be provided at the game display 1000 as illustrated in FIG. 10D. For example, as shown in FIG. 10D, the presentation may include a display of the determined winning prize level with any multipliers and the total amount won 1030 overlaid on the game board portion 1020 and an indication 1031 of the winning prize level 1014 in the prize level display portion 1010 of the game display 1000.

The outcome generation controller 622 operates in response to the player's operation of game play mechanism 56 to place a wager and/or initiate a play of the game and generates a game outcome shown by game display 1000 that is provided to the display controller 625 for presentation at the display 54. The outcome generation controller 622 may comprise suitable logic, circuitry, interfaces and/or code that may be configured to select a winning prize level, selected a pathway to the winning prize level, select multipliers for each of the prize levels, and select a pick to reveal the selected multipliers for each of the prize levels. The outcome generation controller 622 may comprise a prize level selector 622A, a prize pathway selector 622B, a multiplier selector 622C, and a multiplier pick number selector 622D.

The prize level selector 622A may be configured to select a winning prize level from a plurality of prize levels as specified by prize level weighted tables 642 using random number generator 621. The prize level weighted tables 642 may define probabilities for selecting one or more of the prize levels to be the winning prize level. For example, a mini prize level may have the highest probability, the minor prize level may have the second highest probability, the major prize level may have the third highest probability, and the grand prize level may have the lowest probability. Additionally and/or alternatively, the prize level selector 622A may be configured to select a prize level from the prize level weighted tables 642 and remove the selected prize level from the table 642 in response to each user selection of a symbol 1021 presented at the game board 1020 until a predetermined winning number of prize level tokens have been displayed to determine the prize level to award to the user. The prize level tokens may be displayed as defined by prize level symbol data 641.

The prize pathway selector 622B may be configured to select a pathway to the selected prize level from a plurality of pathways to that prize level as specified by pathway weighted tables 643 using random number generator 621. The pathway weighted tables 643 may define probabilities for selecting different pathways to be the winning prize level. The pathway is a predetermined sequence of prize level tokens 1022, 1023, 1024 to be displayed in response to user selections of selectable symbols 1021. For example, the prize level selector 622A may select the winning prize level and the prize pathway selector 622B may select the pathway to the winning prize level selected by the prize level selector 622A. Additionally and/or alternatively, the prize pathway selector 622B may be used to simultaneously select a pathway and the winning prize level. In various embodiments, the selected pathway may include multipliers or the multipliers may be separately determined and/or assigned to tokens by the multiplier selector 622C and multiplier pick number selector 622D as described below. The prize level tokens may be displayed as defined by prize level symbol data 641.

The multiplier selector 622C may be configured to select a multiplier for each of the prize levels as specified by multiplier weighted tables 644 using random number generator 621. The multiplier weighted tables 644 may define probabilities for selecting one of a plurality of multipliers for each of the prize levels. The multipliers may include times one (×1), times two (×2), times three (×3), times five (×5), times ten (×10) or any suitable multiplier. For example, the multiplier selector 622C may select a ×3 mini prize level multiplier, a ×2 minor prize level multiplier, a ×1 major prize level multiplier, and a ×1 grand prize level multiplier. The multipliers are applied to the award values associated with the corresponding prize level. For example, as shown in FIG. 10D, if a ×3 multiplier is selected for a mini prize level having an initial award value of $10.01, the payout for a winning mini prize level would be three times $10.01, which is $30.03. In the above example, the winning value of $30.03 is awarded to the win meter associated with the player and stored in meters 645. In various embodiments, the multiplier weighted tables 644 comprises winning weighted tables 644A and non-winning weighted tables 644B. The multiplier for the winning prize level selected by the prize level selector 622A may be determined by the multiplier selector 622C based on the winning weighted tables 644A and the other multipliers for the non-winning prize levels may be determined by the multiplier selector 622C based on the non-winning weighted tables 644B. The winning weighted tables 644A and non-winning weighted tables 644B are different. For example, the winning weighted tables 644A may have lesser probabilities for having a multiplier greater than ×1 selected than the probabilities defined in the non-winning weighted tables 644B.

The multiplier pick number selector 622D may be configured to select a pick number for displaying the selected multipliers that are greater than ×1 for each of the prize levels using random number generator 621. For example, the multiplier pick number selector 622D may determine that a ×3 multiplier corresponding with the mini prize level be displayed if a second mini prize level token is displayed and a ×2 multiplier corresponding with the minor prize level be displayed if a first minor prize level token is displayed. In the above example, if two mini prize level tokens are not displayed, the selected multiplier would not be displayed. The determination of the pick number for displaying the selected multiplier may be based on an even distribution or a weighted table (not shown). In an alternative embodiment, the multiplier pick number selector 622D may be configured to always display the selected multiplier with the first displayed token.

Figure 7:
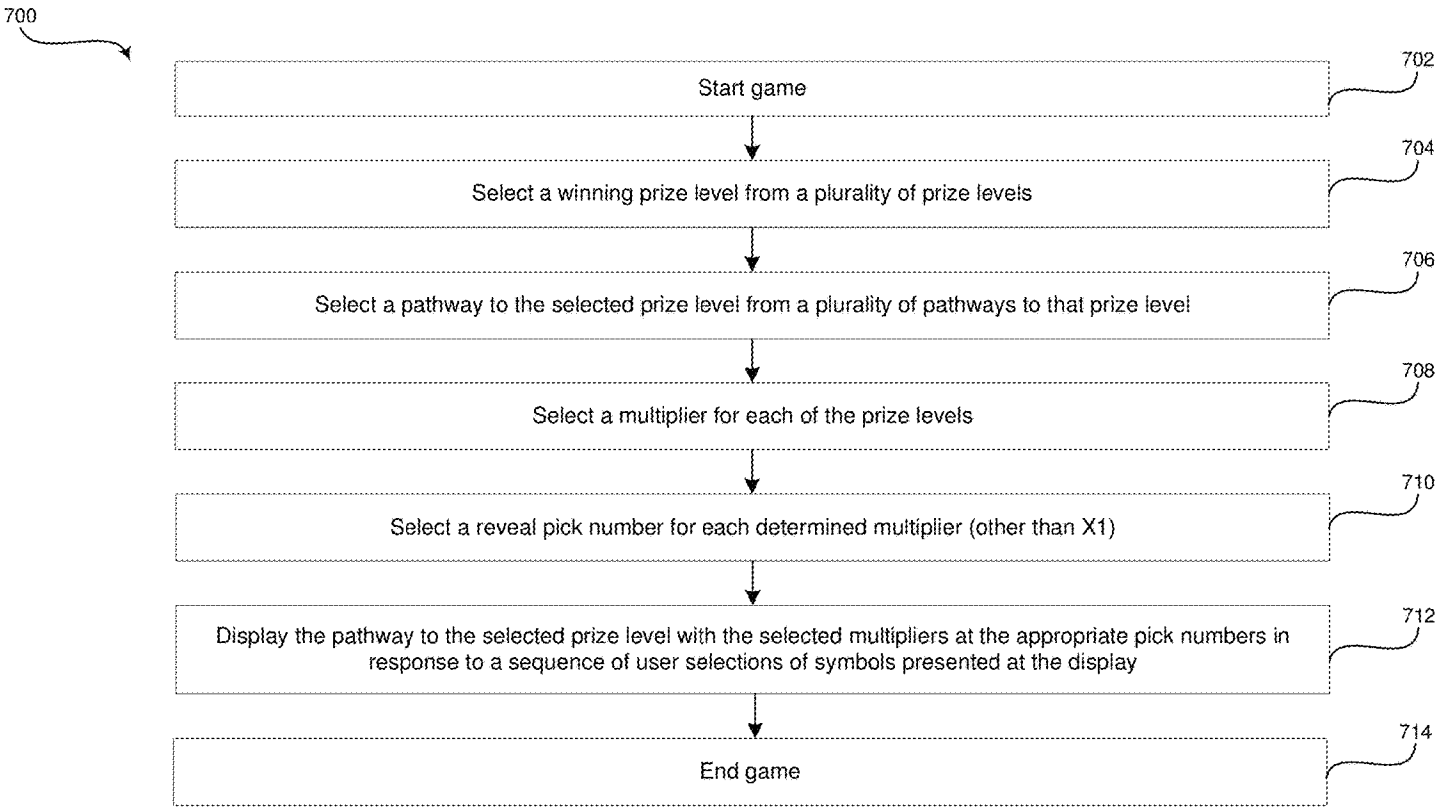
FIG. 7 is a flow chart of a first exemplary embodiment.

FIG. 7 is a flow chart of a first exemplary embodiment having steps 702-714 that may be utilized for providing a pick to reveal jackpot game, in accordance with an embodiment of the invention. Referring to FIG. 7, there is shown a flow chart 700 comprising exemplary steps 702 through 714. Certain embodiments of the present invention may omit one or more of the steps, and/or perform the steps in a different order than the order listed, and/or combine certain of the steps discussed below. For example, some steps may not be performed in certain embodiments of the present invention. As a further example, certain steps may be performed in a different temporal order, including simultaneously, than listed below.

At step 702, the game is started by a processor 62 of a game controller 60 at a gaming system 1. For example, the game may be a stand alone game or a bonus game launched from a primary game, among other things. The game is a pick to reveal jackpot game having a game board portion 1020 of a display 1000 to determine a prize level award depicted in a prize level display portion 1010 of the display 1000. The prize level display portion 1010 presents a plurality of prize levels 1011-1014 having different prize values. The game board portion 1020 presents a number of selectable symbols 1021 that reveal different prize level tokens 1022-1024 upon selection by a user. The number of selectable symbols 1021 set forth in the game board portion 1020 may depend on the number of prize levels 1011-1014 and the number of prize level tokens that need to be selected to win. For example, if there are four prize levels (e.g., grand, major, minor, and mini) and three tokens of the same prize level need to be selected to win that prize level, the game board may include twelve selectable symbols. The selectable symbols may be presented in the game board as a grid having a predetermined number of columns and rows or any suitable arrangement. The game may be associated with a theme. For example, FIGS. 10A-D are screenshots of the pick to reveal jackpot game having a Walking Dead theme where the selectable symbols 1021 depict various Walking Dead characters.

At step 704, the processor 62 of the game controller 60 at the gaming system 1 selects a winning prize level from a plurality of prize levels. For example, if there are four prize levels (e.g., grand, major, minor, and mini), the processor 62 may select one of the four prize levels to be the winning prize level. The processor 62 may include an outcome generation controller 622 having a prize level selector 622A to select the winning prize level based on prize level weighted tables 642 and using a random number generator 621. The weighted tables 642 define a probability of each of the prize levels being selected as the winning prize level. For example, the weighted tables 642 may specify that the lower prize levels such as minor and mini have a higher probability of being selected than the higher prize levels such as major and grand. In various embodiments, each of the prize levels may be associated with a different probability of being selected by the weighted tables 642. Although the above examples set forth a grand prize level, a major prize level, a minor prize level, and a mini prize level, any suitable number of prize levels is contemplated, such as two prize levels, three prize levels, five prize levels, and the like. Moreover, the name of each of the prize levels may be any suitable name.

At step 706, the processor 62 of the game controller 60 at the gaming system 1 selects a pathway to the selected prize level from a plurality of pathways to that prize level. For example, if there are four prize levels (e.g., grand, major, minor, and mini) and the mini prize level was selected at step 704, a pathway to displaying a predetermined number (e.g., three) of mini tokens is selected. One example of a pathway to three mini tokens is: grand, mini, minor, major, mini, grand, mini. Another example of a pathway to three mini tokens is: major, major, mini, minor, mini, mini. The processor 62 may comprise an outcome generation controller 622 having a prize pathway selector 622B that selects the pathway based on pathway weighted tables 643 and using a random number generator 621. Although the above examples set forth a predetermined number of three tokens are displayed to determine the winning prize level, any suitable predetermined number of tokens is contemplated, such as two tokens, four tokens, and the like. In various embodiments, step 704 may be skipped and/or otherwise combined with step 706. For example, the winning prize level may be determined based on the selected pathway.

At step 708, the processor 62 of the game controller 60 at the gaming system selects a multiplier for each of the prize levels. For example, if there are four prize levels (e.g., grand, major, minor, and mini), the processor 62 may select a multiplier for each of the four prize levels. The multiplier may be times one (×1), times two (×2), times three (×3), times five (×5), times ten (×10), or any suitable multiplier. The processor 62 may comprise an outcome generation controller 622 having a multiplier selector 622C that selects the multiplier based on multiplier weighted tables 644 and using a random number generator 621. The multiplier weighted tables 644 may include winning multiplier weighted tables 644A and non-winning multiplier weighted tables 644B. The winning multiplier weighted tables 644A may be applied to select the multiplier for the winning prize level selected at step 704. The non-winning multiplier weighted tables 644B may be applied to select the multiplier for the other prize levels not selected at step 704. In various embodiments, the multipliers may be selected for each prize level before or simultaneously with steps 704 and/or 706. For example, the multiplier for each prize level may be selected before the winning prize level is selected at step 704. As another example, the multipliers may be included in the pathways selected at step 706.

At step 710, the processor 62 of the game controller 60 at the gaming system 1 selects a reveal pick number for each determined multiplier that is different than times one (×1). The processor 62 may comprise an outcome generation controller 622 having a multiplier pick number selector 622D configured to select a pick number for displaying multipliers that are greater than times one (×1) with the appropriate prize level token. As an example, if there are four prize levels (e.g., grand, major, minor, and mini) and the multipliers selected at step 708 are ×1 for grand, ×1 for major, ×2 for minor, and ×3 for mini, the multiplier pick number selector 622D may determine that the ×2 multiplier for the minor prize level will be presented with the first displayed minor prize level token and the ×3 multiplier for the mini prize level will be presented with the second displayed mini prize level token. In the above example, if two mini prize level tokens are not displayed, the selected multiplier would not be displayed. The determination of the pick number for displaying the selected multiplier may be based on an even distribution or a weighted table. In an alternative embodiment, the multiplier pick number selector 622D may be configured to always display the selected multiplier with the first displayed token. In certain embodiments, the reveal pick number may be selected before or simultaneously with steps 704, 706, and/or 708. For example, the multiplier for each prize level determined at step 708 and the reveal pick number selected at step 710 may be performed before the winning prize level is selected at step 704. As another example, the multipliers may be included in the pathways selected at step 706, thereby defining the reveal pick number within the pathway.

At step 712, the processor 62 of the game controller 60 at the gaming system 1 presents the pathway to the selected winning prize level with the selected multipliers at the appropriate pick numbers in response to a sequence of user selections of symbols 1021 presented at the display 54. The outcome generation controller 622 provides the sequence of prize level tokens corresponding with the selected pathway and leading to the selected winning prize level with the selected multipliers at the selected reveal pick numbers to the display controller 625 for generating the game display 1000 having the prize level display portion 1010 and the game board portion 1020. The appearance of the sequence of prize level tokens for presentation in the game board portion 1020 may be based on prize level symbol data 641. The presentation of the prize level display portion 1010 may be based on the prize level symbol data 641 and the values associated with the prize levels may be based on values stored in meters 645. For example, as shown in FIGS. 10A-10C, as a user selects symbols 1021, the pathway of prize level tokens 1022 are revealed including multipliers 1023, 1024 where appropriate until the predetermined number of one prize level token is revealed. In the example shown in FIGS. 10A-10C, three mini tokens are revealed in the pathway sequence of major, major, mini, minor, mini, mini. The ×3 multiplier for the mini prize level and ×2 multiplier for minor prize level were displayed with the first reveal pick number corresponding with each of the mini and minor prize levels, respectively. Although it appears to a player that the prize level tokens 1022, 1023, 1024 were associated with each of the selected symbols 1021, the prize level tokens 1022, 1023, 1024 are displayed in the order determined by the selected pathway irrespective of the symbols 1021 in the game board portion 1020 selected by the player.

At step 714, the game is ended by the processor 62 of the game controller 60 at the gaming system 1. The winning prize level and associated value as modified by any multiplier may be displayed 1030 at the conclusion of the game as shown in FIG. 10D. For example, the presentation 1030, 1031 of the determined winning prize level may include a display of the determined winning prize level with any multipliers and the total amount won 1030 overlaid on the game board portion 1020 and an indication 1031 of the winning prize level 1014 in the prize level display portion 1010 of the game display 1000. The winning value may be awarded to the win meter associated with the player and stored in meters 645. In an embodiment, if the game is a feature game, the processor 62 of the gaming system 1 may revert to the primary game at the conclusion of the feature game. Additionally and/or alternatively, the player(s) may cash out at the conclusion of the game.

Figure 8:
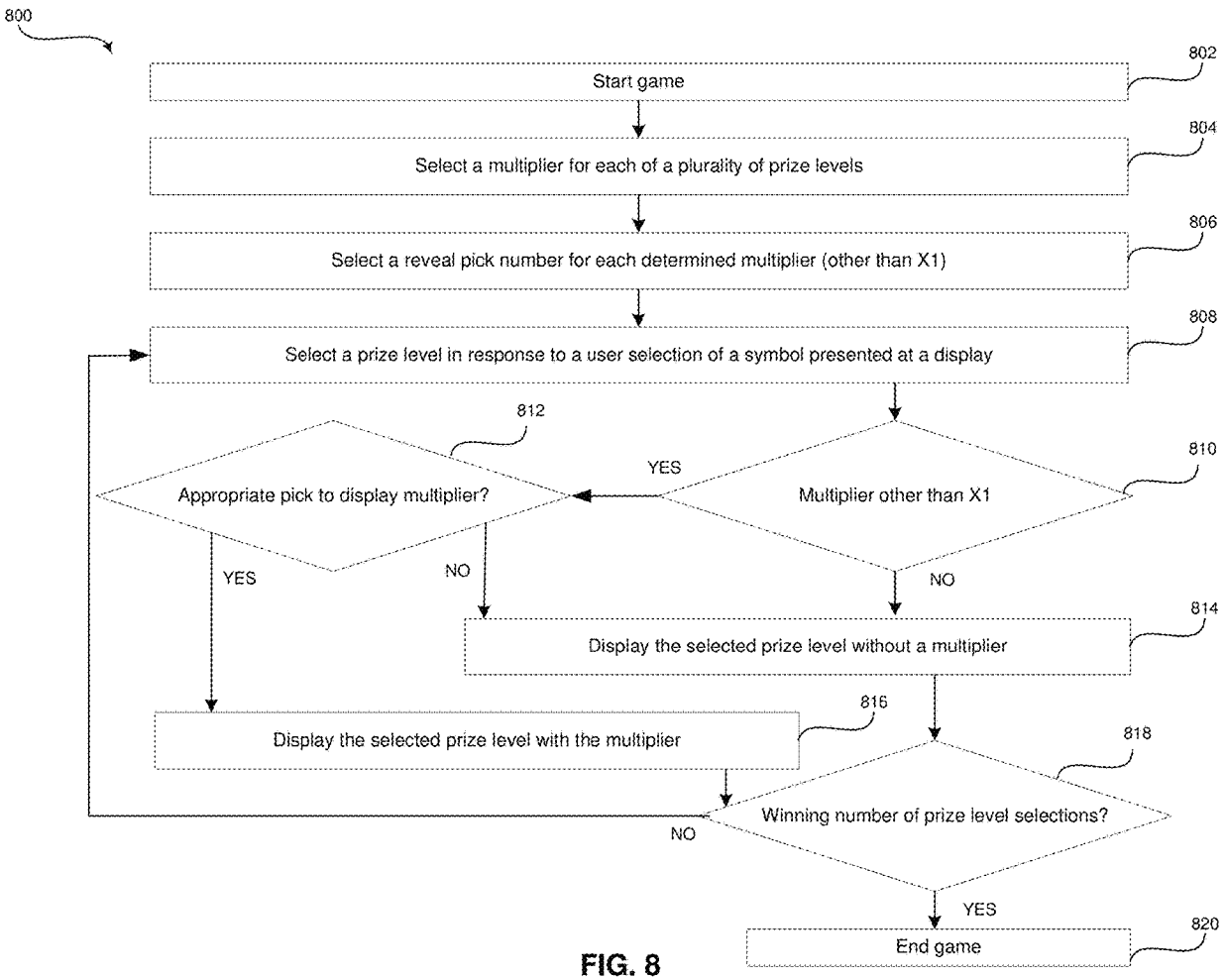
FIG. 8 is a flow chart of a second exemplary embodiment.

FIG. 8 is a flow chart of a second exemplary embodiment having steps 802-820 that may be utilized for providing a pick to reveal jackpot game, in accordance with an embodiment of the invention. Referring to FIG. 8, there is shown a flow chart 800 comprising exemplary steps 802 through 820. Certain embodiments of the present invention may omit one or more of the steps, and/or perform the steps in a different order than the order listed, and/or combine certain of the steps discussed below. For example, some steps may not be performed in certain embodiments of the present invention. As a further example, certain steps may be performed in a different temporal order, including simultaneously, than listed below.

At step 802, the game is started by a processor 62 of a game controller 60 at a gaming system 1. For example, the game may be a stand alone game or a bonus game launched from a primary game, among other things. The game is a pick to reveal jackpot game having a game board portion 1020 of a display 1000 to determine a prize level award depicted in a prize level display portion 1010 of the display 1000. The prize level display portion 1010 presents a plurality of prize levels 1011-1014 having different prize values. The game board portion 1020 presents a number of selectable symbols 1021 that reveal different prize level tokens 1022-1024 upon selection by a user. The number of selectable symbols 1021 set forth in the game board portion 1020 may depend on the number of prize levels 1011-1014 and the number of prize level tokens that need to be selected to win. For example, if there are four prize levels (e.g., grand, major, minor, and mini) and three tokens of the same prize level need to be selected to win that prize level, the game board may include twelve selectable symbols. The selectable symbols may be presented in the game board as a grid having a predetermined number of columns and rows or any suitable arrangement. The game may be associated with a theme. For example, FIGS. 10A-D are screenshots of the pick to reveal jackpot game having a Walking Dead theme where the selectable symbols 1021 depict various Walking Dead characters.

At step 804, the processor 62 of the game controller 60 at the gaming system selects a multiplier for each of the prize levels. For example, if there are four prize levels (e.g., grand, major, minor, and mini), the processor 62 may select a multiplier for each of the four prize levels. The multiplier may be times one (×1), times two (×2), times three (×3), times five (×5), times ten (×10), or any suitable multiplier. The processor 62 may comprise an outcome generation controller 622 having a multiplier selector 622C that selects the multiplier based on multiplier weighted tables 644 and using a random number generator 621.

At step 806, the processor 62 of the game controller 60 at the gaming system 1 selects a reveal pick number for each determined multiplier that is different than times one (×1). The processor 62 may comprise an outcome generation controller 622 having a multiplier pick number selector 622D configured to select a pick number for displaying multipliers that are greater than times one (×1) with the appropriate prize level token. As an example, if there are four prize levels (e.g., grand, major, minor, and mini) and the multipliers selected at step 804 are ×1 for grand, ×1 for major, ×2 for minor, and ×3 for mini, the multiplier pick number selector 622D may determine that the ×2 multiplier for the minor prize level will be presented with the first displayed minor prize level token and the ×3 multiplier for the mini prize level will be presented with the second displayed mini prize level token. In the above example, if two mini prize level tokens are not displayed, the selected multiplier would not be displayed. The determination of the pick number for displaying the selected multiplier may be based on an even distribution or a weighted table. In an alternative embodiment, the multiplier pick number selector 622D may be configured to always display the selected multiplier with the first displayed token.

At step 808, the processor 62 of the game controller 60 at the gaming system 1 is configured to select a prize level in response to a user selection of a symbol 1021 presented at display 54. The processor 62 may comprise an outcome generation controller 622 having a prize level selector 622A configured to select a prize level from prize level weighted tables 642 using the random number generator 621 in response to a user selection of a symbol 1021 presented at the game board portion 1020 of the game display 1000. The selected prize level may be removed from the table 642 after the selection. For example, if there are four prize levels (e.g., grand, major, minor, and mini) and the predetermined number of prize level tokens to achieve a winning prize level is three, the table 642 may include three grand prize level tokens, three major prize level tokens, three minor prize level tokens, and three mini prize level tokens. If the first token selected from the table 642 is a major prize level token, the selected major prize level token will be removed leaving two major prize level tokens. The selected tokens are removed after each selection leaving the non-selected tokens until all of the prize level tokens for one of the prize levels have been selected, thereby determining the winning prize level. In various embodiments, the prize level may be selected before or simultaneously with steps 804 and/or 806. For example, the prize level may be selected before the multiplier is selected in step 804. As another example, the prize level weighted tables 642 may include multipliers associated with one or more of the prize level tokens provided in the tables 642.

At step 810, the processor 62 of the game controller 60 at the gaming system 1 determines whether the prize level selected at step 808 is associated with a multiplier other than times one (×1) as specified by step 804. If the prize level selected at step 808 is associated with a multiplier other than ×1, the method proceeds to step 812 as described below. If the prize level selected at step 808 is associated with a ×1 multiplier, the method proceeds to step 814 as described below.

At step 812, the processor 62 of the game controller 60 at the gaming system 1 determines whether it is the appropriate pick, as determined by step 806, to display the multiplier, determined at step 804, with the prize level selected at step 808. For example, if the selected prize level is a mini prize level associated with a ×3 multiplier that is revealed with the second mini prize level token, the processor 62 determines whether the mini prize level token about to be displayed is the second mini prize level token being displayed. If it is the appropriate pick to display the multiplier associated with the selected prize level, the method proceeds to step 816 where the multiplier is displayed with the selected prize level as described below. If it is not the appropriate pick to display the multiplier associated with the selected prize level, the method proceeds to step 814 where the selected prize level is displayed without the multiplier.

At step 814, the processor 62 of the game controller 60 at the gaming system 1 displays the selected prize level without a multiplier. The processor 62 may comprise a display controller 625 configured to generate a game display 1000 having the game board portion 1020. The display controller 625 presents the selected prize level token 1022 in place of the symbol 1021 selected by the user. The appearance of the selected prize level token presented in the game board portion 1020 may be based on prize level symbol data 641.

At step 816, the processor 62 of the game controller 60 at the gaming system 1 displays the selected prize level with the multiplier 1023. The processor 62 may comprise a display controller 625 configured to generate a game display 1000 having the game board portion 1020. The display controller 625 presents the selected prize level token with the multiplier 1023 in place of the symbol 1021 selected by the user. The appearance of the selected prize level token presented in the game board portion 1020 may be based on prize level symbol data 641. In various embodiments, the multiplier 1015 may also be shown with the corresponding prize level 1014 in the prize level display portion 1010 of the game display 1000. For example, as the multiplier is displayed with the prize level token 1023 at the game board portion 1020, a duplicate multiplier 1015 may float up from the token 1023 to be presented adjacent the appropriate prize level 1014 in the prize level display portion 1010.

At step 818, the processor 62 of the game controller 60 at the gaming system 1 determines whether a predetermined winning number of one prize level token have been selected and displayed. For example, if the predetermined winning number of tokens is three, the processor 62 determines whether three tokens associated with one prize level have been selected and displayed. If three tokens associated with one prize level have been selected and displayed, a winning prize level has been determined and the method proceeds to step 820 as described below. If three tokens associated with one prize level have not been selected and displayed, the method returns to step 808 to continue selecting a prize level in response to a user selection of a symbol 1021 presented at display 54. Although the above examples set forth a predetermined number of three tokens are displayed to determine the winning prize level, any suitable predetermined number of tokens is contemplated, such as two tokens, four tokens, and the like.

At step 820, the game is ended by the processor 62 of the game controller 60 at the gaming system 1. The winning prize level and associated value as modified by any multiplier may be displayed 1030 at the conclusion of the game as shown in FIG. 10D. For example, the presentation 1030, 1031 of the determined winning prize level may include a display of the determined winning prize level with any multipliers and the total amount won 1030 overlaid on the game board portion 1020 and an indication 1031 of the winning prize level 1014 in the prize level display portion 1010 of the game display 1000. The winning value may be awarded to the win meter associated with the player and stored in meters 645. In an embodiment, if the game is a feature game, the processor 62 of the gaming system 1 may revert to the primary game at the conclusion of the feature game. Additionally and/or alternatively, the player(s) may cash out at the conclusion of the game.

Figure 9:
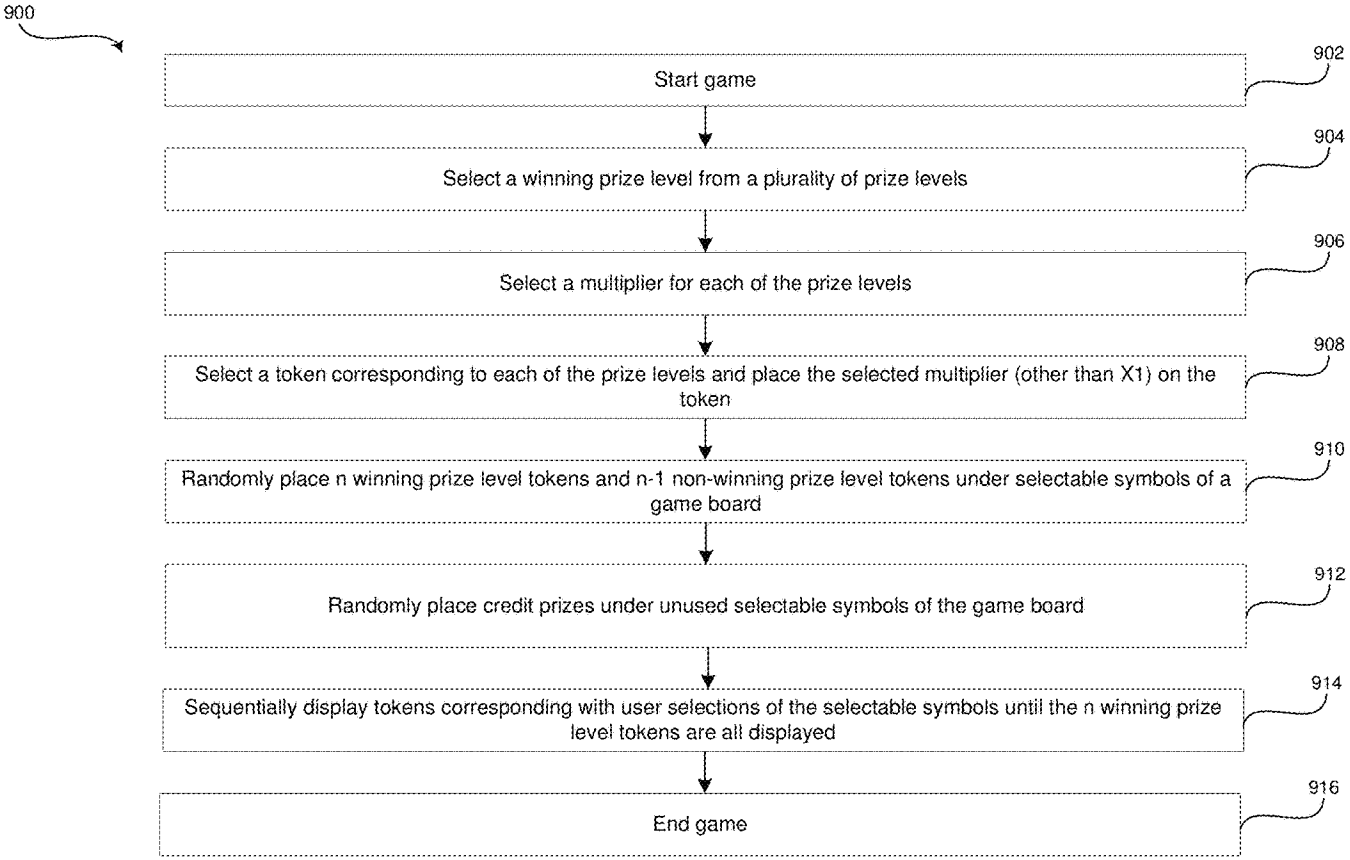
FIG. 9 is a flow chart of a third exemplary embodiment.

FIG. 9 is a flow chart of a third exemplary embodiment having steps 902-916 that may be utilized for providing a pick to reveal jackpot game, in accordance with an embodiment of the invention. Referring to FIG. 9, there is shown a flow chart 900 comprising exemplary steps 902 through 916. Certain embodiments of the present invention may omit one or more of the steps, and/or perform the steps in a different order than the order listed, and/or combine certain of the steps discussed below. For example, some steps may not be performed in certain embodiments of the present invention. As a further example, certain steps may be performed in a different temporal order, including simultaneously, than listed below.

At step 902, the game is started by a processor 62 of a game controller 60 at a gaming system 1. For example, the game may be a stand alone game or a bonus game launched from a primary game, among other things. The game is a pick to reveal jackpot game having a game board portion 1020 of a display 1000 to determine a prize level award depicted in a prize level display portion 1010 of the display 1000. The prize level display portion 1010 presents a plurality of prize levels 1011-1014 having different prize values. The game board portion 1020 presents a number of selectable symbols 1021 that reveal different prize level tokens 1022-1024 upon selection by a user. The number of selectable symbols 1021 set forth in the game board portion 1020 may depend on the number of prize levels 1011-1014 and the number of prize level tokens that need to be selected to win. For example, if there are four prize levels (e.g., grand, major, minor, and mini) and three tokens of the same prize level need to be selected to win that prize level, the game board may include twelve selectable symbols. The selectable symbols may be presented in the game board as a grid having a predetermined number of columns and rows or any suitable arrangement. The game may be associated with a theme. For example, FIGS. 10A-D are screenshots of the pick to reveal jackpot game having a Walking Dead theme where the selectable symbols 1021 depict various Walking Dead characters.

At step 904, the processor 62 of the game controller 60 at the gaming system 1 selects a winning prize level from a plurality of prize levels. For example, if there are four prize levels (e.g., grand, major, minor, and mini), the processor 62 may select one of the four prize levels to be the winning prize level. The processor 62 may include an outcome generation controller 622 having a prize level selector 622A to select the winning prize level based on prize level weighted tables 642 and using a random number generator 621. The weighted tables 642 define a probability of each of the prize levels being selected as the winning prize level. For example, the weighted tables 642 may specify that the mini prize level may have the highest probability, the minor prize level may have the second highest probability, the major prize level may have the third highest probability, and the grand prize level may have the lowest probability. Although the above examples set forth a grand prize level, a major prize level, a minor prize level, and a mini prize level, any suitable number of prize levels is contemplated, such as two prize levels, three prize levels, five prize levels, and the like. Moreover, the name of each of the prize levels may be any suitable name.

At step 906, the processor 62 of the game controller 60 at the gaming system 1 selects a multiplier for each of the prize levels. For example, if there are four prize levels (e.g., grand, major, minor, and mini), the processor 62 may select a multiplier for each of the four prize levels. The multiplier may be times one (×1), times two (×2), times three (×3), times five (×5), times ten (×10), or any suitable multiplier. The processor 62 may comprise an outcome generation controller 622 having a multiplier selector 622C that selects the multiplier based on multiplier weighted tables 644 and using a random number generator 621. In various embodiments, the odds of selecting at least some of the multipliers may be different. For example, the probability of selecting the ×1 multiplier may be greater than the probability for selecting multipliers greater than one. The multiplier weighted tables 644 may include winning multiplier weighted tables 644A and non-winning multiplier weighted tables 644B. The winning multiplier weighted tables 644A may be applied to select the multiplier for the winning prize level selected at step 704. The non-winning multiplier weighted tables 644B may be applied to select the multiplier for the other prize levels not selected at step 704. In various embodiments, the multipliers may be selected for each prize level before or simultaneously with step 904. For example, the multiplier for each prize level may be selected before the winning prize level is selected at step 904.

At step 908, the processor 62 of the game controller 60 at the gaming system 1 selects a token corresponding to each of the prize levels and places the selected multiplier other than times one (×1) on the selected token. For example, if there are four prize levels (e.g., grand, major, minor, and mini) and the multipliers selected at step 906 are ×1 for grand, ×1 for major, ×2 for minor, and ×3 for mini, the processor 62 may assign the ×2 multiplier to one of the minor prize level tokens and the ×3 multiplier to one of the mini prize level tokens.

At step 910, the processor 62 of the game controller 60 at the gaming system 1 randomly places n winning prize level tokens and n−1 non-winning prize level tokens under selectable symbols 1021 of the game board portion 1020 of the game display 1000. For example, if the predetermined winning number of tokens is three (n=3), the processor 62 randomly associates three (n) winning prize level tokens and two (n−1) non-winning prize level tokens with different selectable symbols 1021. Accordingly, each of the assigned tokens is associated with one of the selectable symbols 1021 and is displayed in response to a user selection of the respective selectable symbol 1021 as described below with respect to step 914. Although the above examples set forth a predetermined number of three tokens are displayed to determine the winning prize level, any suitable predetermined number of tokens is contemplated, such as two tokens, four tokens, and the like.

At step 912, the processor 62 of the game controller 60 at the gaming system 1 randomly places credit prizes under unused selectable symbols 1021 of the game board 1020. For example, if there are four prize levels (e.g., grand, major, minor, and mini) and three tokens of the same prize level need to be selected to win that prize level, the game board may include twelve selectable symbols. If three winning prize level tokens and six non-winning prize level tokens are associated with selectable symbols 1021 at step 910, three unused selectable symbols 1021 remain in the game board portion 1020. The three unused selectable symbols 1021 may be associated with credit prizes such as game credits, food credits, or any suitable prize credits.

At step 914, the processor 62 of the game controller 60 at the gaming system 1 sequentially displays the prize level tokens with associated multipliers where applicable in response to user selections of symbols 1021 until the n winning prize level tokens are all presented at the display 54. The outcome generation controller 622 provides the prize level tokens 1022, 1023, 1024 corresponding with the selected symbols 1021 to the display controller 625 for generating the game display 1000 having the prize level display portion 1010 and the game board portion 1020. The appearance of the prize level tokens for presentation in the game board portion 1020 may be based on prize level symbol data 641. The presentation of the prize level display portion 1010 may be based on the prize level symbol data 641 and the values associated with the prize levels may be based on values stored in meters 645. For example, as shown in FIGS. 10A-10C, as a user selects symbols 1021, the corresponding prize level tokens 1022 are revealed including multipliers 1023, 1024 where appropriate until the predetermined number of one prize level token is revealed. In the example shown in FIGS. 10A-10C, three mini tokens are eventually revealed in response to user selections of symbols 1021 corresponding with major, major, mini ×3, minor ×2, mini, mini prize level tokens 1022, 1023, 1024.

At step 916, the game is ended by the processor 62 of the game controller 60 at the gaming system 1. The winning prize level and associated value as modified by any multiplier may be displayed 1030 at the conclusion of the game as shown in FIG. 10D. For example, the presentation 1030, 1031 of the determined winning prize level may include a display of the determined winning prize level with any multipliers and the total amount won 1030 overlaid on the game board portion 1020 and an indication 1031 of the winning prize level 1014 in the prize level display portion 1010 of the game display 1000. The winning value may be awarded to the win meter associated with the player and stored in meters 645. In an embodiment, if the game is a feature game, the processor 62 of the gaming system 1 may revert to the primary game at the conclusion of the feature game. Additionally and/or alternatively, the player(s) may cash out at the conclusion of the game.

FIG. 10A is a screen shot of an example of a display of a pick to reveal jackpot game 1000 having a prize level display portion 1010 and a game board portion 1020. Referring to FIG. 10A, the pick to reveal jackpot game 1000 comprises a prize level display portion 1010 and a game board portion 1020. The prize level display portion 1010 comprises a plurality of prize levels 1011-1014 and values corresponding with the prize values 1011-1014. The game board portion 1020 presents a number of symbols 1021 selectable by a user. The number of selectable symbols 1021 set forth in the game board portion 1020 may depend on the number of prize levels 1011-1014 and the number of prize level tokens that need to be selected to win. For example, if there are four prize levels (e.g., grand, major, minor, and mini) and three tokens of the same prize level need to be selected to win that prize level, the game board may include twelve selectable symbols. The selectable symbols may be presented in the game board as a grid having a predetermined number of columns and rows or any suitable arrangement. The game may be associated with a theme. For example, FIG. 10A is a screenshot of the pick to reveal jackpot game having a Walking Dead theme where the selectable symbols 1021 depict various Walking Dead characters. The pick to reveal jackpot game 1000 is presented at a display 54.

FIG. 10B is a screen shot of an example of a display of a pick to reveal jackpot game 1000 having a prize level display portion 1010 and a game board portion 1020 presenting prize level tokens 1022 and a multiplier for a prize level 1015, 1023. Referring to FIG. 10B, the prize level display portion 1010 presents a plurality of prize levels 1011-1014 having different prize values and a multiplier 1015 associated with one of the prize levels 1014. The game board portion 1020 presents a number of selectable symbols 1021 that reveal different prize level tokens 1022, 1023 upon selection by a user. The pick to reveal jackpot game 1000 is presented at a display 54.

FIG. 10C is a screen shot of an example of a display of a pick to reveal jackpot game 1000 having a prize level display portion 1010 and a game board portion 1020 presenting prize level tokens 1022 that define a winning prize level and multipliers for different prize levels 1015, 1016, 1023, 1024. Referring to FIG. 10C, the prize level display portion 1010 presents a plurality of prize levels 1011-1014 having different prize values and multipliers 1015, 1016 associated with two of the prize levels 1013, 1014. The game board portion 1020 presents a number of selectable symbols 1021 that reveal different prize level tokens 1022, 1023, 1024 upon selection by a user. The prize level tokens 1022, 1023, 1024 displayed in FIG. 10C show a winning combination of three mini prize level tokens. The pick to reveal jackpot game 1000 is presented at a display 54.

FIG. 10D is a screen shot of an example of a display of a pick to reveal jackpot game 1000 presenting the winning jackpot prize level awarded 1030, 1031. Referring to FIG. 10D, the prize level display portion 1010 presents a plurality of prize levels 1011-1014 having different prize values and multipliers 1015, 1016 associated with two of the prize levels 1013, 1014. The winning prize level 1014 is indicated 1031 in the prize level display portion 1010. The winning jackpot prize level awarded 1030 is also overlaid over the game board portion 1020 of the pick to reveal jackpot game 1000. The pick to reveal jackpot game 1000 is presented at a display 54.

Aspects of the present invention provide an electronic method of gaming 700 in a gaming system 1, 10, 100 comprising a display 14, 54, 106 and a game controller 60, 101. The method 700 comprises displaying 702, on the display, a pick to reveal jackpot game 1000 having a game board portion 1020 presenting a plurality of selectable symbols 1021. The method 700 comprises selecting 704, by the game controller 60, 62, 101, 622, 622A, a winning prize level from a plurality of prize levels. The method 700 comprises selecting 706, by the game controller 60, 62, 101, 622, 622B, a pathway to the selected winning prize level from a plurality of pathways to the selected winning prize level. The method 700 comprises selecting 708, by the game controller 60, 62, 101, 622, 622C, a multiplier for each of the plurality of prize levels. In various embodiments, one or more of the multipliers is greater than times one. The method 700 comprises displaying 712, by the game controller 60, 62, 101, 625 on the display 14, 54, 106, the selected pathway to the selected winning prize level with the one or more of the selected multipliers greater than times one in response to a sequence of user selections of a subset of the plurality of selectable symbols 1021.

In certain embodiments, the selected pathway comprises a predetermined order of prize level tokens 1022, 1023, 1024. Each of the prize level tokens 1022, 1023, 1024 is associated with one of the plurality of prize levels. The prize level tokens 1022, 1023, 1024 are displayed one at a time in the predetermined order according to the selected pathway in response to the sequence of user selections of the subset of the plurality of selectable symbols 1021. In a respective embodiment, the one or more of the selected multipliers greater than times one is displayed as part of a corresponding one of the prize level tokens 1023, 1024. In various embodiments, the method 700 comprises selecting 710, by the game controller 60, 62, 101, 622, 622D, a reveal pick number for each of the one or more of the selected multipliers greater than times one. The reveal pick number identifies the corresponding one of the prize level tokens 1023, 1024 in the selected pathway for which each of the one or more of the selected multipliers greater than times one is displayed.

In a representative embodiment, the selection of one or more of the winning prize level, the pathway, and the multiplier is based at least in part on a respective weighted table 642, 643, 644. In certain embodiments, the selection of the multiplier for the selected winning prize level is based at least in part on a first weighted table 644A. The selection of the multiplier for each of the plurality of prize levels other than the selected winning prize level is based at least in part on a second weighted table 644B different from the first weighted table 644A.

In various embodiments, the pick to reveal jackpot game 1000 comprises a prize level display portion 1010 that presents each of the plurality of prize levels 1011-1014 and an award value associated with each of the plurality of prize levels 1011-1014. In a representative embodiment, the one or more of the selected multipliers greater than times one 1015, 1016 is displayed with the corresponding one of the plurality of prize levels 1013, 1014 in the prize level display portion 1010 of the pick to reveal jackpot game 1000. In certain embodiments, the method 700 comprises executing computer program code 641-645. In various embodiments, the method 700 comprises storing the computer program code 641-645 in a tangible computer readable medium 64, 103.

Certain embodiments provide an electronic game controller 60, 62, 101, 622 comprising a prize level selector 622A, a prize pathway selector 622B, a multiplier selector 622C, and a display controller 625. The prize level selector 622A is configured to select a winning prize level from a plurality of prize levels. The prize pathway selector 622B is configured to select a pathway to the selected winning prize level from a plurality of pathways to the selected winning prize level. The multiplier selector 622C is configured to select a multiplier for each of the plurality of prize levels. In various embodiments, one or more of the multipliers is greater than times one. The display controller 625 is configured to control a display 14, 54, 106 of a gaming system 1, 10, 100 to display a pick to reveal jackpot game 1000 having a game board portion 1020 presenting a plurality of selectable symbols 1021. The display controller 625 is configured to control a display 14, 54, 106 of a gaming system 1, 10, 100 to display the selected pathway to the selected winning prize level with the one or more of the selected multipliers greater than times one in response to a sequence of user selections of a subset of the plurality of selectable symbols 1021.

In various embodiments, the selected pathway comprises a predetermined order of prize level tokens 1022, 1023, 1024. Each of the prize level tokens 1022, 1023, 1024 is associated with one of the plurality of prize levels 1011-1014. The display controller 625 is configured to display the prize level tokens 1022, 1023, 1024 one at a time in the predetermined order according to the selected pathway in response to the sequence of user selections of the subset of the plurality of selectable symbols 1021. In a representative embodiment, the display controller 625 is configured to display the one or more of the selected multipliers greater than times one as part of a corresponding one of the prize level tokens 1023, 1024. In certain embodiments, the electronic game controller 60, 62, 101, 622 comprises a multiplier pick number selector 622D configured to select a reveal pick number for each of the one or more of the selected multipliers greater than times one. The reveal pick number identifies the corresponding one of the prize level tokens 1023, 1024 in the selected pathway for which each of the one or more of the selected multipliers greater than times one is displayed.

In a representative embodiment, the selection of one or more of the winning prize level by the prize level selector 622A, the pathway by the prize pathway selector 622B, and the multiplier by the multiplier selector 622C is based at least in part on a respective weighted table 642, 643, 644. In certain embodiments, the selection of the multiplier for the selected winning prize level by the multiplier selector 622C is based at least in part on a first weighted table 644A. The selection of the multiplier for each of the plurality of prize levels other than the selected winning prize level by the multiplier selector 622C is based at least in part on a second weighted table 644B different from the first weighted table 644A. In various embodiments, the display controller 625 is configured to display the pick to reveal jackpot game 1000 comprising a prize level display portion 1010 that presents each of the plurality of prize levels 1011-1014 and an award value associated with each of the plurality of prize levels 1011-1014. In a representative embodiment, the display controller 625 is configured to display the one or more of the selected multipliers greater than times one 1015, 1016 with the corresponding one of the plurality of prize levels 1013, 1014 in the prize level display portion 1010 of the pick to reveal jackpot game 1000.

Various embodiments provide a gaming system 1, 10, 100 comprising a display 14, 54, 106 and a game controller 60, 62, 101, 622. The game controller 60, 62, 101, 622 is configured to present, on the display 14, 54, 106, a pick to reveal jackpot game 1000 having a game board portion 1020 presenting a plurality of selectable symbols 1021. The game controller 60, 62, 101, 622 configured to select a winning prize level from a plurality of prize levels. The game controller 60, 62, 101, 622 configured to select a pathway to the selected winning prize level from a plurality of pathways to the selected winning prize level. The game controller 60, 62, 101, 622 configured to select a multiplier for each of the plurality of prize levels. In various embodiments, one or more of the multipliers is greater than times one. The game controller 60, 62, 101, 622 configured to present, on the display 14, 54, 106, the selected pathway to the selected winning prize level with the one or more of the selected multipliers greater than times one in response to a sequence of user selections of a subset of the plurality of selectable symbols 1021.

In a representative embodiment, the selected pathway comprises a predetermined order of prize level tokens 1022, 1023, 1024. Each of the prize level tokens 1022, 1023, 1024 is associated with one of the plurality of prize levels 1011-1014. The game controller 60, 62, 101, 622 is configured to present, on the display, the prize level tokens 1022, 1023, 1024 one at a time in the predetermined order according to the selected pathway in response to the sequence of user selections of the subset of the plurality of selectable symbols 1021. The game controller 60, 62, 101, 622 is configured to present, on the display 14, 54, 106, the one or more of the selected multipliers greater than times one as part of a corresponding one of the prize level tokens 1023, 1024. The game controller 60, 62, 101, 622 is configured to select a reveal pick number for each of the one or more of the selected multipliers greater than times one. The reveal pick number identifies the corresponding one of the prize level tokens 1023, 1024 in the selected pathway for which each of the one or more of the selected multipliers greater than times one is presented.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art will appreciate that program code provides a series of instructions executable by the processor.

It will be understood to persons skilled in the art of the invention that many modifications may be made without departing from the spirit and scope of the invention. In particular, it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An electronic method of gaming in a gaming system comprising a display and a game controller, the electronic method comprising:

displaying, on the display, a pick to reveal jackpot game having a game board portion presenting a plurality of selectable symbols;

selecting, by the game controller, a winning prize level from a plurality of prize levels;

selecting, by the game controller, a pathway to the selected winning prize level from a plurality of pathways to the selected winning prize level;

selecting, by the game controller, a multiplier for each of the plurality of prize levels, wherein one or more of the multipliers is greater than times one; and displaying, by the game controller on the display, the selected pathway to the selected winning prize level with the one or more of the selected multipliers greater than times one in response to a sequence of user selections of a subset of the plurality of selectable symbols.

2. The electronic method of claim 1, wherein the selected pathway comprises a predetermined order of prize level tokens, each of the prize level tokens associated with one of the plurality of prize levels, and wherein the prize level tokens are displayed one at a time in the predetermined order according to the selected pathway in response to the sequence of user selections of the subset of the plurality of selectable symbols.

3. The electronic method of claim 2, wherein the one or more of the selected multipliers greater than times one is displayed as part of a corresponding one of the prize level tokens.

4. The electronic method of claim 3, comprising selecting a reveal pick number for each of the one or more of the selected multipliers greater than times one, wherein the reveal pick number identifies the corresponding one of the prize level tokens in the selected pathway for which each of the one or more of the selected multipliers greater than times one is displayed.

5. The electronic method of claim 1, wherein the selection of one or more of the winning prize level, the pathway, and the multiplier is each based at least in part on a respective weighted table.

6. The electronic method of claim 1, wherein the selection of the multiplier for the selected winning prize level is based at least in part on a first weighted table, and wherein the selection of the multiplier for each of the plurality of prize levels other than the selected winning prize level is based at least in part on a second weighted table distinct from the first weighted table.

7. The electronic method of claim 1, wherein the pick to reveal jackpot game comprises a prize level display portion that presents each of the plurality of prize levels and an award value associated with each of the plurality of prize levels.

8. The electronic method of claim 7, wherein the one or more of the selected multipliers greater than times one is displayed with a corresponding one of the plurality of prize levels in the prize level display portion of the pick to reveal jackpot game.

9. The electronic method of claim 1, comprising executing by the game controller, computer program code to select the winning prize level, the pathway, and the multiplier and to display the selected pathway.

10. The electronic method of claim 9, wherein the computer program code is read from a tangible computer readable medium.

11. An electronic game controller comprising:

an outcome generation controller configured to:

select a winning prize level from a plurality of prize levels;

select a pathway to the selected winning prize level from a plurality of pathways to the selected winning prize level; and select a multiplier for each of the plurality of prize levels, wherein one or more of the multipliers is greater than times one; and a display controller configured to control a display of a gaming system to:

display a pick to reveal jackpot game having a game board portion presenting a plurality of selectable symbols, and display the selected pathway to the selected winning prize level with the one or more of the selected multipliers greater than times one in response to a sequence of user selections of a subset of the plurality of selectable symbols.

12. The electronic game controller of claim 11, wherein the selected pathway comprises a predetermined order of prize level tokens, each of the prize level tokens associated with one of the plurality of prize levels, and wherein the display controller is configured to display the prize level tokens one at a time in the predetermined order according to the selected pathway in response to the sequence of user selections of the subset of the plurality of selectable symbols.

13. The electronic game controller of claim 12, wherein the display controller is configured to display the one or more of the selected multipliers greater than times one as part of a corresponding one of the prize level tokens.

14. The electronic game controller of claim 13, wherein the outcome generation controller is configured to select a reveal pick number for each of the one or more of the selected multipliers greater than times one, wherein the reveal pick number identifies the corresponding one of the prize level tokens in the selected pathway for which each of the one or more of the selected multipliers greater than times one is displayed.

15. The electronic game controller of claim 11, wherein the selection of one or more of the winning prize level, the pathway and the multiplier is each based at least in part on a respective weighted table.

16. The electronic game controller of claim 11, wherein the selection of the multiplier for the selected winning prize level is based at least in part on a first weighted table, and wherein the selection of the multiplier for each of the plurality of prize levels other than the selected winning prize level is based at least in part on a second weighted table distinct from the first weighted table.

17. The electronic game controller of claim 11, wherein the display controller is configured to display the pick to reveal jackpot game comprising a prize level display portion that presents each of the plurality of prize levels and an award value associated with each of the plurality of prize levels.

18. The electronic game controller of claim 17, wherein the display controller is configured to display the one or more of the selected multipliers greater than times one with a corresponding one of the plurality of prize levels in the prize level display portion of the pick to reveal jackpot game.

19. A gaming system comprising:

a display;

a game controller configured to:

present, on the display, a pick to reveal jackpot game having a game board portion presenting a plurality of selectable symbols;

select a winning prize level from a plurality of prize levels;

select a pathway to the selected winning prize level from a plurality of pathways to the selected winning prize level;

select a multiplier for each of the plurality of prize levels, wherein one or more of the multipliers is greater than times one; and present, on the display, the selected pathway to the selected winning prize level with the one or more of the selected multipliers greater than times one in response to a sequence of user selections of a subset of the plurality of selectable symbols.

20. The gaming system of claim 19, wherein the selected pathway comprises a predetermined order of prize level tokens, each of the prize level tokens associated with one of the plurality of prize levels, and wherein the game controller is configured to:

present, on the display, the prize level tokens one at a time in the predetermined order according to the selected pathway in response to the sequence of user selections of the subset of the plurality of selectable symbols;

present, on the display, the one or more of the selected multipliers greater than times one as part of a corresponding one of the prize level tokens; and select a reveal pick number for each of the one or more of the selected multipliers greater than times one, wherein the reveal pick number identifies the corresponding one of the prize level tokens in the selected pathway for which each of the one or more of the selected multipliers greater than times one is presented.

* * * * *